US009323227B1

(12) United States Patent
He et al.

(10) Patent No.: US 9,323,227 B1
(45) Date of Patent: Apr. 26, 2016

(54) LED CLOCK

(71) Applicant: LIQ MENG CORP., Taipei (TW)

(72) Inventors: Yuan-Xing He, Chengdu (CN); Guo-Hao Liang, Guangdong (CN)

(73) Assignee: LIQ MENG CORP., Taipei (TW)

( * ) Notice: Subject to any disclaimer, the term of this patent is extended or adjusted under 35 U.S.C. 154(b) by 0 days.

(21) Appl. No.: 14/850,356

(22) Filed: Sep. 10, 2015

(30) Foreign Application Priority Data

Mar. 4, 2015 (CN) ..... 2015 2 0123487 U

(51) Int. Cl.

| | |
|---|---|
| ***G04B 19/30*** | (2006.01) |
| ***G04B 37/00*** | (2006.01) |
| ***G04C 3/00*** | (2006.01) |
| ***G04C 10/00*** | (2006.01) |
| ***G04G 9/04*** | (2006.01) |
| ***G04B 37/14*** | (2006.01) |

(52) U.S. Cl.
CPC *G04G 9/04* (2013.01); *G04B 19/30* (2013.01); *G04B 37/0066* (2013.01); *G04B 37/1473* (2013.01); *G04C 3/008* (2013.01); *G04C 10/00* (2013.01)

(58) Field of Classification Search
CPC ..... G04B 19/30; G04B 37/0066; G04B 37/1473; G04C 3/008; G04C 10/00; G04G 9/04
See application file for complete search history.

(56) References Cited

U.S. PATENT DOCUMENTS

| | | | | |
|---|---|---|---|---|
| 2,655,783 | A * | 10/1953 | Uschkamp | G04B 19/305 368/226 |
| 3,798,892 | A * | 3/1974 | Lukens | G04B 19/34 368/234 |
| 4,161,098 | A * | 7/1979 | Ingendahl | G04B 19/082 368/76 |
| 6,290,387 | B1 * | 9/2001 | Chen | G04B 37/1473 368/316 |
| 6,942,380 | B1 * | 9/2005 | Lin | G04B 37/1473 368/276 |
| 2007/0247974 | A1 * | 10/2007 | Duwe | G04B 19/30 368/1 |
| 2007/0291592 | A1 * | 12/2007 | Heineman | G04C 11/00 368/46 |

* cited by examiner

*Primary Examiner* — Vit W Miska
(74) *Attorney, Agent, or Firm* — Rabin & Berdo, P.C.

(57) ABSTRACT

Provided is an LED clock having multiple LEDs to illuminate the clock indirectly. The multiple LEDs do not aim towards the viewers directly. The present invention provides comfort for the viewers' eyes when the viewers look at the LED clock. In addition, the LED clock also can be used as a floor lamp. This new function as a floor lamp enhances the supplementary value of the LED clock effectively.

8 Claims, 5 Drawing Sheets

LED CLOCK

BACKGROUND OF THE INVENTION

1. Field of the Invention

The present invention relates to an LED clock, and more particularly to an LED clock that has an indirect lighting and can serve both as a clock and a floor lamp.

2. Description of the Related Art

A conventional light emission device for a clock is a single light source or multiple lamps arranged in a partial area of the clock. This light emission device only can illuminate topical area of the clock. If the surrounding or ambient light is not sufficient to illuminate the whole clock, viewers can hardly identify the correct time only by the above light emission device.

In order to resolve this problem, multiple light emission devices are installed on each hour numeral of the clock. This arrangement can help viewers to identify the correct time by the brightened numerals, but the light beams aim towards the viewers' eyes directly from the light emission devices. The light beams might be too harsh or dazzling to the eyes, which makes the viewers uncomfortable.

SUMMARY OF THE INVENTION

An objective of the present invention is to provide an indirect lighting for a clock; the indirect lighting can illuminate the hour numerals of the clock indirectly and help viewers to identify the correct time at night or in a dimly lit environment. In addition, the indirect lighting can protect viewers' eyes and help viewers to look at the clock with ease and comfort.

To achieve the foregoing objective, the LED clock comprises: a body, a support stand, and a support base. The body includes a front side and a back side, and comprises: a frame, a circuit board, multiple LEDs, a light directing cover, and a clock. The frame includes a groove and an annular opening. The annular opening is formed from the front side towards the back side within the groove. The circuit board is mounted in the groove. The multiple LEDs are mounted spacedly on the circuit board and the LEDs aim outwards through the annular opening. The light directing cover is a transparent sheet. The shape of the light directing cover is corresponding to the groove, and the light directing cover covers the annular opening. The clock is mounted at the geometric center of the frame.

The clock further comprises: a movement, an hour hand, and a minute hand. The hour hand and the minute hand are connected to the movement. At least one rib is formed between the frame and the movement. The movement comprises a power supply, and the power supply is electrically connected to the circuit board through the at least one rib.

The support stand comprises a first end and a second end. The first end is connected to the frame, and the second end is opposite to the first end.

The support base is connected to the second end of the support stand.

The advantage of the present invention is that the LED clock provides a groove from the front side towards the back side of the body to install the circuit board and the LEDs. The groove helps the LEDs to emit light towards the back side of the body such that the light beams from the LEDs can illuminate the clock indirectly. This arrangement can avoid the light beams aiming to the viewers' eyes directly from the LEDs. Viewers can look at the present invention with comfort.

Particularly, the frame comprises: multiple numeral parts and numeral connecting parts. The LEDs are mounted and spaced equidistantly on the circuit board within the numeral parts and the numeral connecting parts of the frame. The advantage of the present invention is that the LEDs are mounted spacedly in the numeral parts and the numeral connecting parts to ensure that all parts of the clock can be uniformly illuminated.

Particularly, the first end of the support stand is a hose. The advantage of the present invention is that the support stand can be bended easily by hands. This design provides a new function of the LED clock as a floor lamp.

More particularly, two ribs are formed between the frame and the movement. The two ribs are rigid structures and the two ribs are mounted at two opposite positions. The advantage of the present invention is that the movement can be fixed with the frame by the two ribs when the body and the support stand are bended relatively. This design enhances the stability for fixing the clock on the body.

DETAILED DESCRIPTION OF THE INVENTION

Figure 1:
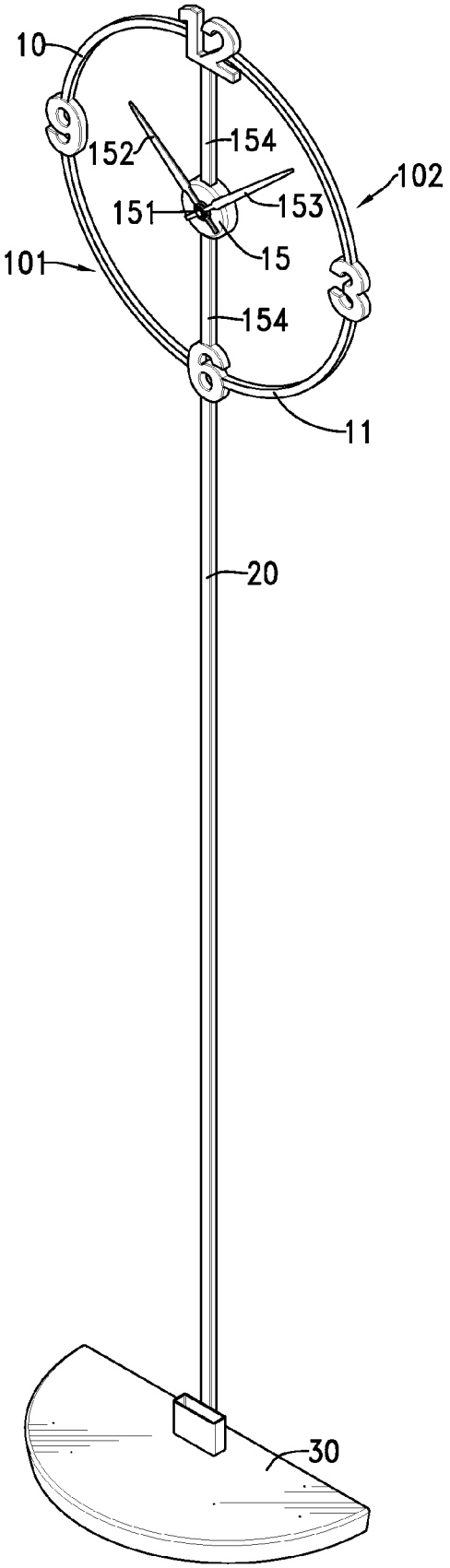
FIG. 1 is a perspective view of the LED clock in accordance with the present invention.

With reference to FIG. 1, an LED clock in accordance with the present invention comprises a body 10, a support stand 20, and a support base 30.

Figure 2:
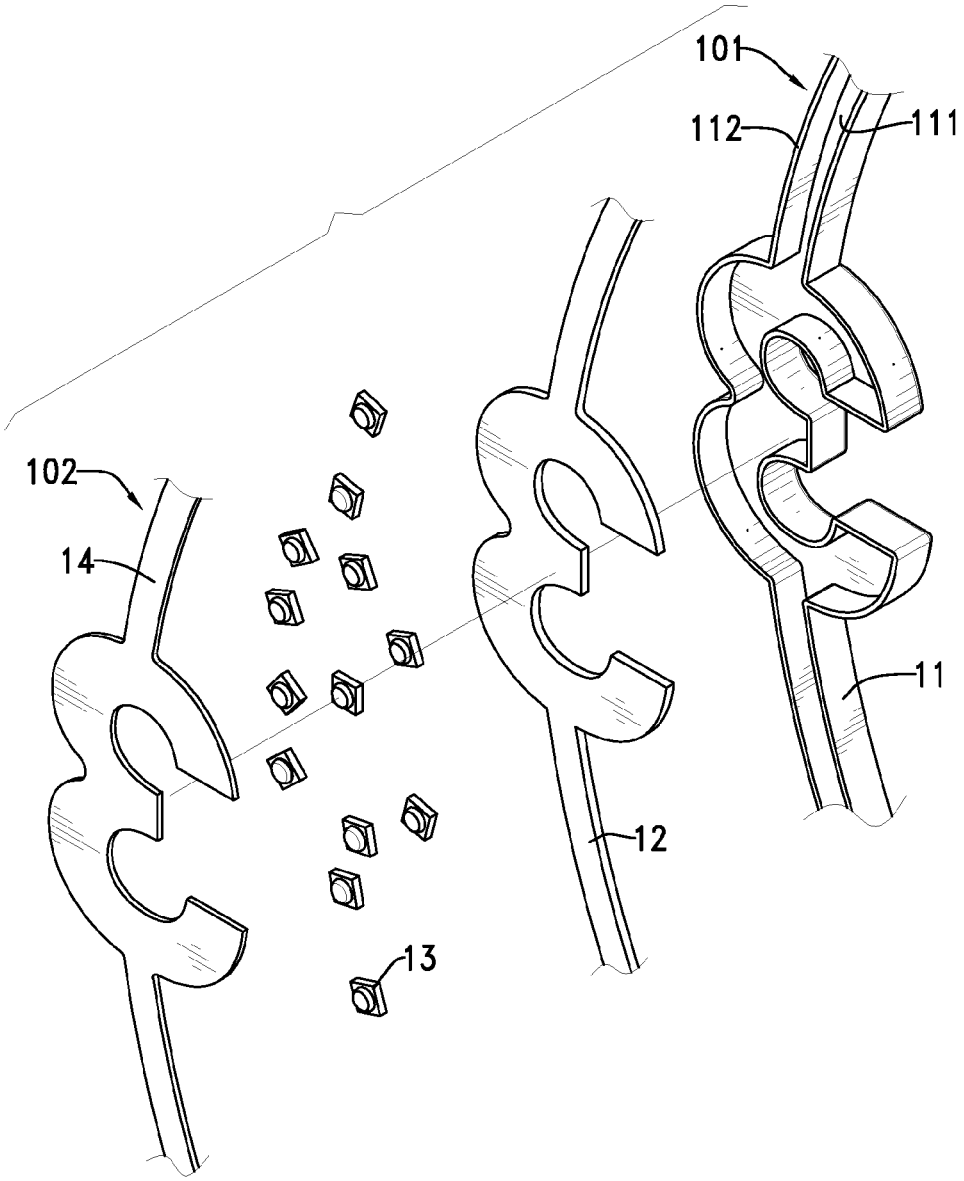
FIG. 2 is an exploded perspective view in partial section of the LED clock in accordance with the present invention.
Figure 3:
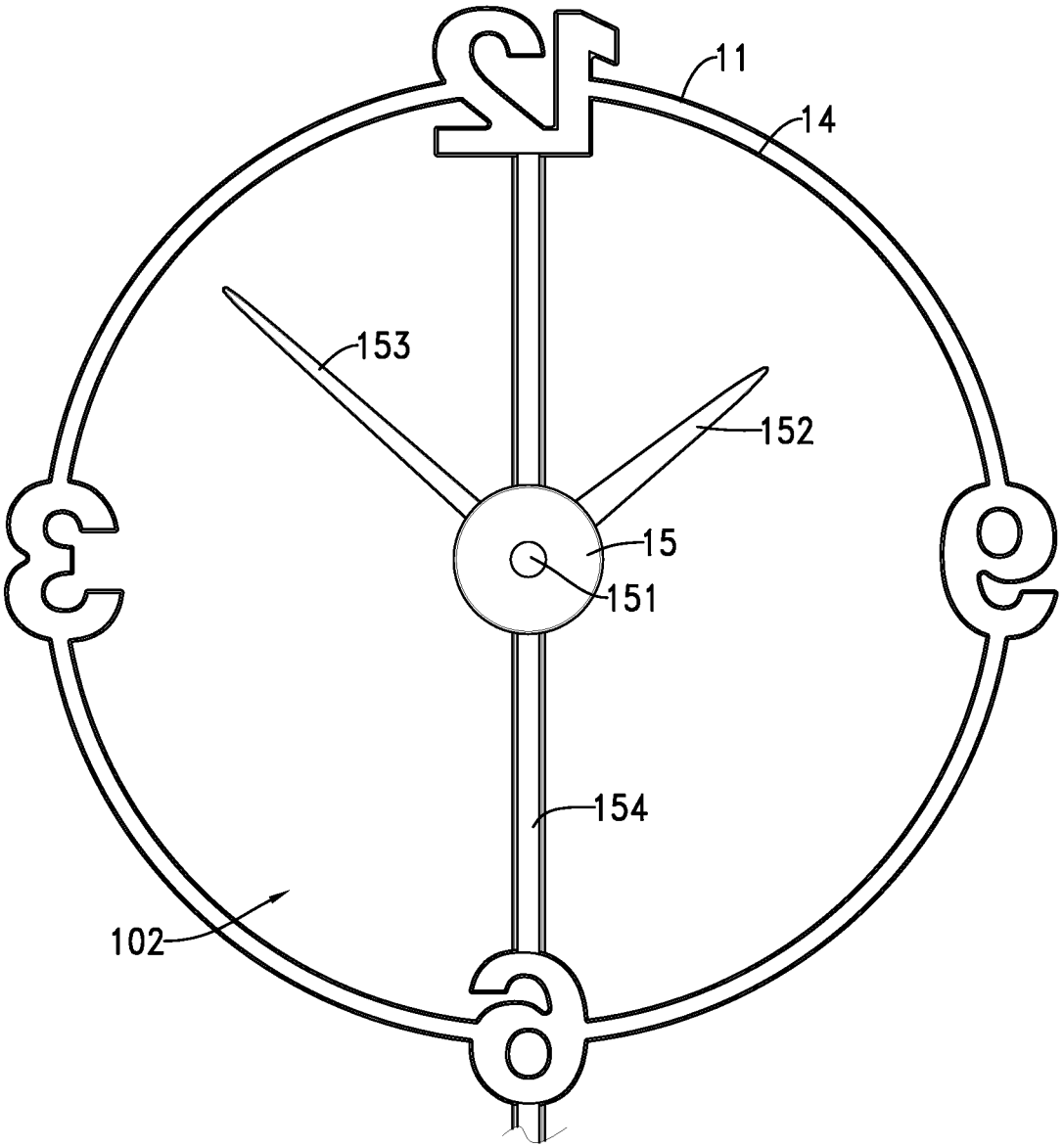
FIG. 3 is a back view of the LED clock in accordance with the present invention.

The body 10 includes a front side 101 and a back side 102. With reference to FIGS. 1 to 3, the body 10 further comprises a frame 11, a circuit board 12, multiple LEDs 13, a light directing cover 14, and a clock 15.

The frame 11 has multiple numeral parts and numeral connecting parts. Specifically, the amount of the multiple numeral parts is four. The multiple numeral parts are the numerals 3, 6, 9, and 12 respectively. The numeral connecting parts link between 3 and 6, 6 and 9, 9 and 12, and 3 and 12. The frame 11 includes a groove 111, and an annular opening 112 is formed from the front side 101 towards the back side 102 within the groove 111.

The circuit board 12 is mounted in the groove 111. The multiple LEDs 13 are mounted spacedly on the circuit board 12 and the LEDs 13 aim outwards through the annular opening 112. Therefore, the LEDs 13 emit light towards the back side 102 of the body 10.

The light directing cover 14 is a transparent sheet. The shape of the light directing cover 14 is corresponding to the groove 111 and the annular opening 112. The light directing cover 14 covers the annular opening 112 and closes the groove 111. With this arrangement, the light beams from the LEDs 13 illuminate outside of the frame 11 softly via the light directing cover 14.

The clock 15 is mounted at the geometric center of the frame 11. Specifically, the clock 15 is mounted at the geometric center of the multiple numeral parts: 3, 6, 9, 12 and the numeral connecting parts. The clock 15 further comprises a movement 151, an hour hand 152, and a minute hand 153. The hour hand 152 and the minute hand 153 are connected to the movement 151. Two ribs 154 are formed between the frame 11 and the movement 151. One of the ribs 154 is mounted between the clock 15 and the numeral part of 6, and the other rib 154 is mounted between the clock 15 and the numeral part of 12. Furthermore, the two ribs 154 are rigid structures. The movement 151 further comprises a power supply (not shown in figure), and the power supply is electrically connected to the circuit board 12 via the ribs 154. The multiple LEDs 13 on the circuit board 12 is powered by the power supply and emits light.

With reference to FIG. 1 again, the support stand 20 is a linear rod and the support base 30 is a heavy platform. The linear rod has a first end and a second end. The first end is connected to the numeral part of 6, and the second end is connected to the support base 30. The LED clock can stand on the floor stably by the support stand 20 and the support base 30.

Figure 4:
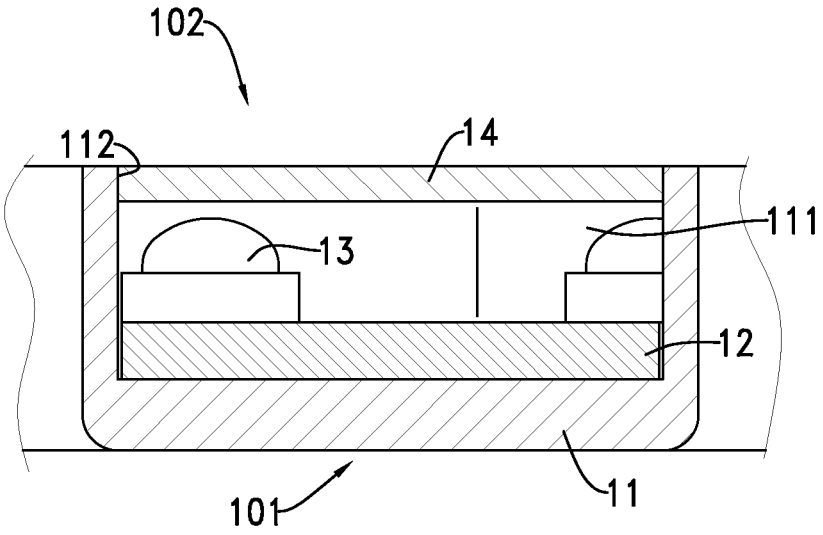
FIG. 4 is a cross-sectional view in partial section of the LED clock in accordance with the present invention.

With reference to FIG. 4, this figure is a cross-sectional view showing the assembly state of the frame 11, circuit board 12, LEDs 13, and light directing cover 14. The groove 111 and the annular opening 112 are formed from the front side 101 towards the back side 102 with the frame 11. First, the circuit board 12 is mounted in the groove 111. Then the multiple LEDs 13 are mounted towards the annular opening 112 on the circuit board 12. Finally, the light directing cover 14 covers the annular opening 112. When the LEDs 13 emit light by the power supply, the light beams from the LEDs 13 penetrate through the light directing cover 14 and illuminate the back side 102. As users always look at the front side 101 of the LED clock, the light beams from the LEDs 13 will not aim towards the viewers' eyes directly. The LEDs 13 provide indirect lighting to the clock and the indirect lighting helps the viewers look at the clock with ease and comfort.

Figure 5:
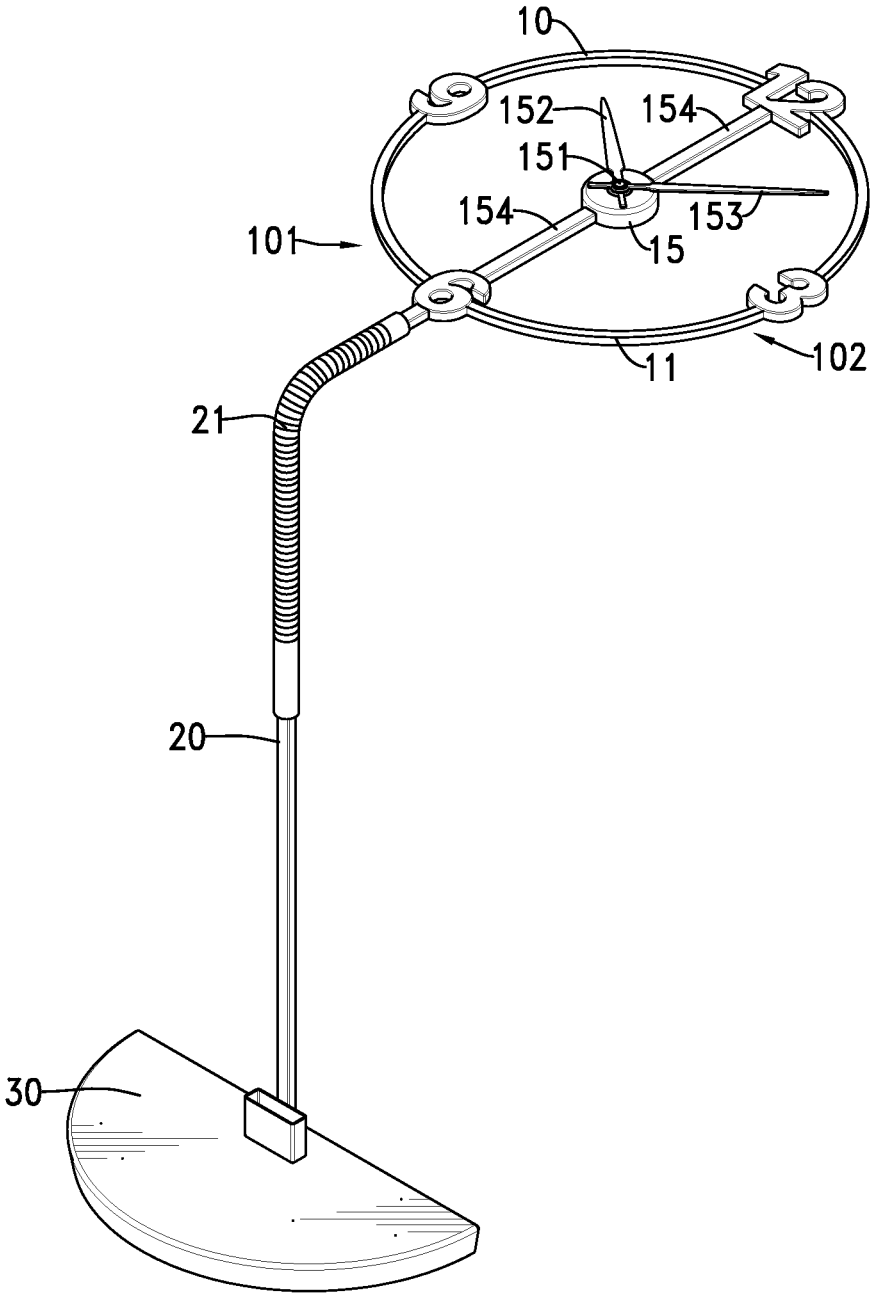
FIG. 5 is a perspective view of another embodiment of the LED clock in accordance with the present invention.

With reference to FIG. 5, the support stand 20 can be in another form. The first end of the support stand 20 is a hose 21 that is flexible. When the support stand 20 is bended, the LED clock is used as a floor lamp. This new function as a floor lamp enhances the supplementary value of the LED clock effectively.

Furthermore, an electronic control device is also installed within the LED clock (not shown in figure). The electronic control device can control brightness of LEDs. The electronic control device can also control the timing for light emission for each LED by circuit design. For example, the LEDs can be turned on or turned off gradually with the moving of the hour hand 152 or the minute hand 153 by the electronic control device. This design can help viewers to identify the correct time quickly.

In summary, the groove 111 is formed from the front side 101 towards the back side 102 to install the LEDs 13 such that the LEDs 13 can emit light towards the back side 102 of the body 10. This arrangement provides an indirect lighting to the clock. And the indirect lighting helps the viewers to look at the clock comfortably. In addition, the present invention also utilizes the LEDs 13 and the hose 21 for use as a floor lamp. The present invention is both a clock and a floor lamp simultaneously. The present invention enhances the supplementary value and function for the LED clock effectively.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An LED clock comprising:
- a body including a front side and a back side, and comprising:
  - a frame including:
    - a groove, and
    - an annular opening formed from the front side towards the back side within the groove;
  - a circuit board mounted in the groove;
  - multiple LEDs mounted spacedly on the circuit board, and aiming outwards through the annular opening;
  - a light directing cover being a transparent sheet, having a shape corresponding to the groove, and covering the annular opening; and
  - a clock mounted at the geometric center of the frame;
- a support stand comprising:
  - a first end connected to the frame; and
  - a second end opposite to the first end; and
- a support base connected to the second end of the support stand;
- wherein the clock further comprises:
  - a movement comprising a power supply;
  - an hour hand connected to the movement;
  - a minute hand connected to the movement; and
  - at least one rib formed between the frame and the movement, wherein the power supply is electrically connected to the circuit board through the at least one rib.

2. The LED clock as claimed in claim 1, wherein the frame comprises multiple numeral parts and numeral connecting parts; and the LEDs are mounted and spaced equidistantly on the circuit board within the numeral parts and the numeral connecting parts.

3. The LED clock as claimed in claim 1, wherein the first end of the support stand is a hose.

4. The LED clock as claimed in claim 2, wherein the first end of the support stand is a hose.

5. The LED clock as claimed in claim 1, wherein two ribs are formed between the frame and the movement; and the two ribs are rigid structures mounted at opposite positions.

6. The LED clock as claimed in claim 2, wherein two ribs are formed between the frame and the movement; and the two ribs are rigid structures mounted at opposite positions.

7. The LED clock as claimed in claim 3, wherein two ribs are formed between the frame and the movement; and the two ribs are rigid structures mounted at opposite positions.

8. The LED clock as claimed in claim 4, wherein two ribs are formed between the frame and the movement; and the two ribs are rigid structures mounted at opposite positions.

* * * * *